US009985358B2

(12) United States Patent
Zhu et al.

(10) Patent No.: US 9,985,358 B2
(45) Date of Patent: May 29, 2018

(54) ELECTRICAL CONNECTOR WITH SHORT LENGTH ALONG MATING DIRECTION

(71) Applicant: FOXCONN INTERCONNECT TECHNOLOGY LIMITED, Grand Cayman (KY)

(72) Inventors: Jian-Kuang Zhu, Kunshan (CN); Wei Zhong, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days. days.

(21) Appl. No.: 15/680,230

(22) Filed: Aug. 18, 2017

(65) Prior Publication Data

US 2018/0054012 A1 Feb. 22, 2018

(30) Foreign Application Priority Data

Aug. 18, 2016 (CN) ..... 2016 1 0680534

(51) Int. Cl.

| | |
|---|---|
| ***H01R 4/02*** | (2006.01) |
| ***H01R 12/77*** | (2011.01) |
| ***H01R 13/62*** | (2006.01) |
| ***H01R 13/6593*** | (2011.01) |
| ***H01R 33/76*** | (2006.01) |
| ***H01R 9/05*** | (2006.01) |
| ***H01R 13/6592*** | (2011.01) |

(52) U.S. Cl.

CPC ..... *H01R 4/023* (2013.01); *H01R 9/0512* (2013.01); *H01R 12/774* (2013.01); *H01R 12/775* (2013.01); *H01R 12/778* (2013.01); *H01R 13/6205* (2013.01); *H01R 13/6592* (2013.01); *H01R 13/6593* (2013.01); *H01R 33/7628* (2013.01)

(58) Field of Classification Search

CPC . H01R 33/7628; H01R 13/6593; H01R 4/023
See application file for complete search history.

(56) References Cited

U.S. PATENT DOCUMENTS 2,557,746 A * 6/1951 Ingham ..... H01R 33/7628 439/851
6,273,749 B1 * 8/2001 Yang ..... H01R 9/0515 439/497

(Continued)

FOREIGN PATENT DOCUMENTS

| | | |
|---|---|---|
| CN | 202268524 U | 6/2012 |
| CN | 103326154 B | 3/2016 |
| CN | 205944620 U | 2/2017 |

*Primary Examiner* — James Harvey
(74) *Attorney, Agent, or Firm* — Wei Te Chung; Ming Chieh Chang

(57) ABSTRACT

An electrical cable connector includes an insulative housing, a plurality of terminals disposed in the housing, a mating cavity formed in the housing and forwardly communicating with an exterior. The terminal includes a front contacting section and a rear connecting section with an extension section therebewteen in a front-to-back direction. The front contacting section is exposed in the mating cavity, and the rear connecting section includes a soldering region and a pair of securing structure formed on two sides of the soldering region and secured to the housing for retaining the terminal in position with regard to the housing.

20 Claims, 13 Drawing Sheets

(56) References Cited

U.S. PATENT DOCUMENTS

| | | | | |
|---|---|---|---|---|
| 6,273,753 | B1 * | 8/2001 | Ko | H01R 9/035 439/497 |
| 6,685,495 | B1 * | 2/2004 | Ko | H01R 4/023 439/353 |
| 7,959,450 | B1 * | 6/2011 | Wang | H01R 4/028 439/135 |
| 9,118,154 | B2 | 8/2015 | Yu et al. | |
| 9,653,849 | B2 * | 5/2017 | Hsu | H01R 13/6584 |
| 2001/0022234 | A1 * | 9/2001 | Okumura | H01R 9/0512 174/78 |
| 2017/0352991 | A1 * | 12/2017 | Lin | H01R 13/6591 |

* cited by examiner

ELECTRICAL CONNECTOR WITH SHORT LENGTH ALONG MATING DIRECTION

BACKGROUND OF THE DISCLOSURE

1. Field of the Disclosure

The invention is an electrical cable connector, and particularly to the electrical cable connector assembly with the barbed soldering tail for shortening the length of the contact and the dimension of the whole connector along the mating direction.

2. Description of Related Arts

A traditional electrical cable connector including an insulative housing, a plurality of terminals disposed in the housing, and metallic shell enclosing the housing wherein the terminal includes a horizontal retention base, a resilient contacting section extending forwardly from the base, and a tail section extending rearwardly from the base for soldering to the corresponding wire. Notably, the retention base is equipped with the barbs for retaining the contact in the corresponding passageway of the housing. Anyhow, because of existence of the retention base, the length of the contact could not be significantly reduced, thus precluding minimizing the dimension of the whole electrical cable connector in the mating/front-to-back direction.

An electrical cable connector with the shortened contact length for minimizing the dimension of the whole connector is desired

SUMMARY OF THE DISCLOSURE

To achieve the above desire, an electrical cable connector includes an insulative housing, a plurality of terminals disposed in the housing, a mating cavity formed in the housing and forwardly communicating with an exterior. The terminal includes a front contacting section and a rear connecting section with an extension section therebewteen in a front-to-back direction. The front contacting section is exposed in the mating cavity, and the rear connecting section includes a soldering region and a pair of securing structure formed on two sides of the soldering region and secured to the housing for retaining the terminal in position with regard to the housing. Understandably, because the traditional retention base no longer exists, the length of the terminal along the front-to-back direction may be reduced to minimize the dimension of the whole connector.

DETAILED DESCRIPTION OF THE PREFERRED EMBODIMENT

Figure 1:
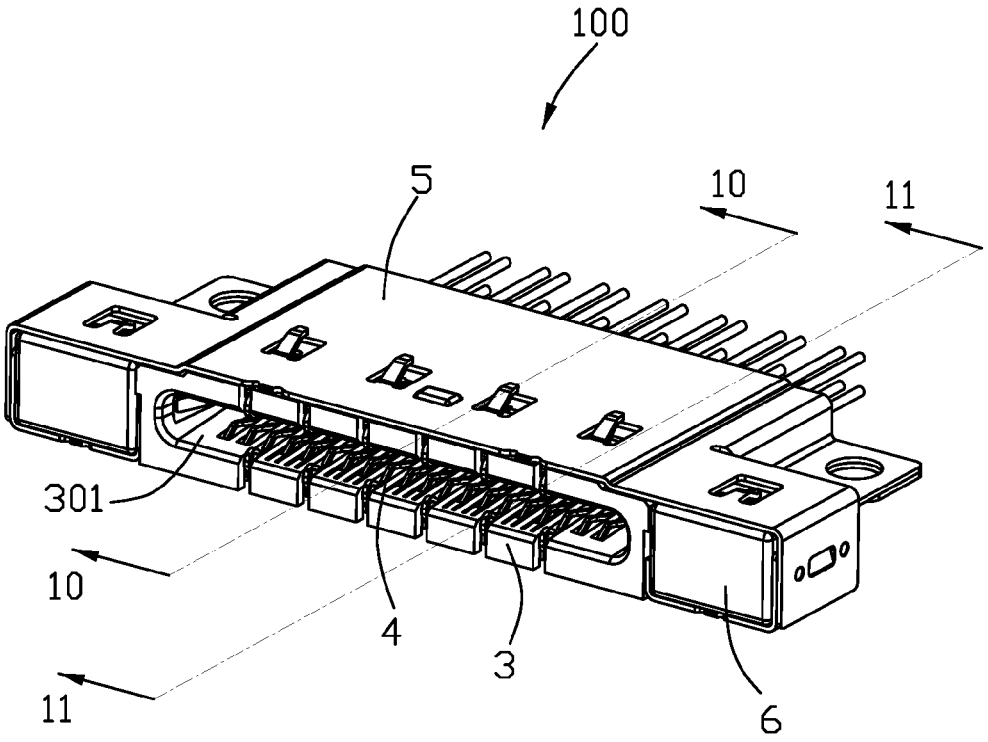
FIG. 1 is a perspective view of an electrical cable connector according to the invention.
Figure 2:
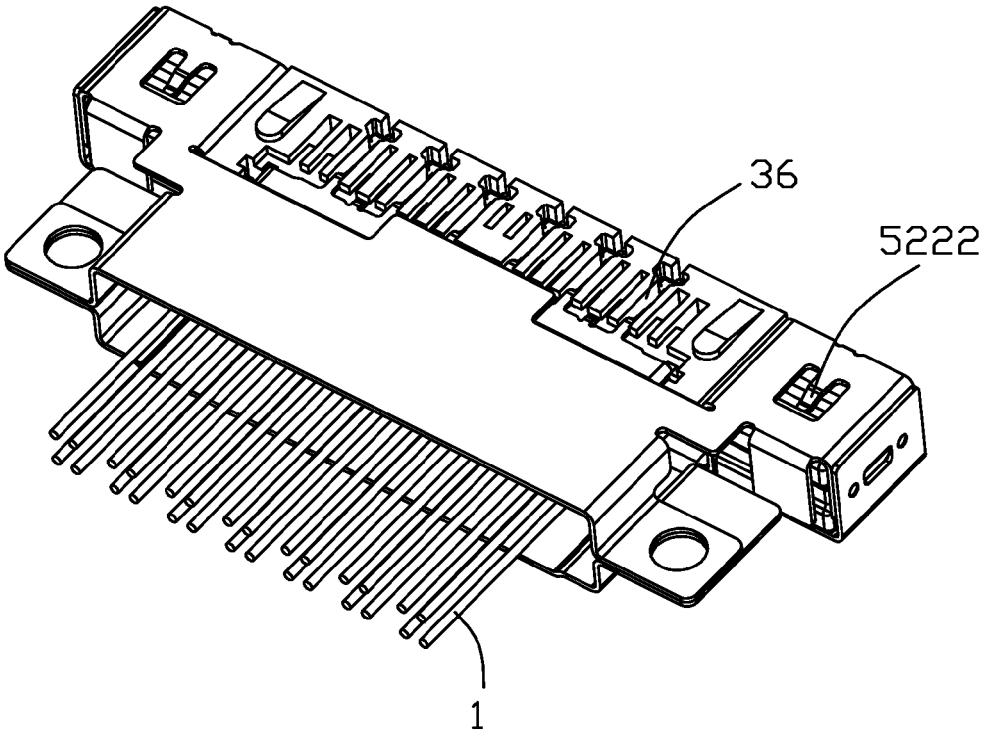
FIG. 2 is another perspective view of the electrical cable connector of FIG. 1.
Figure 3:
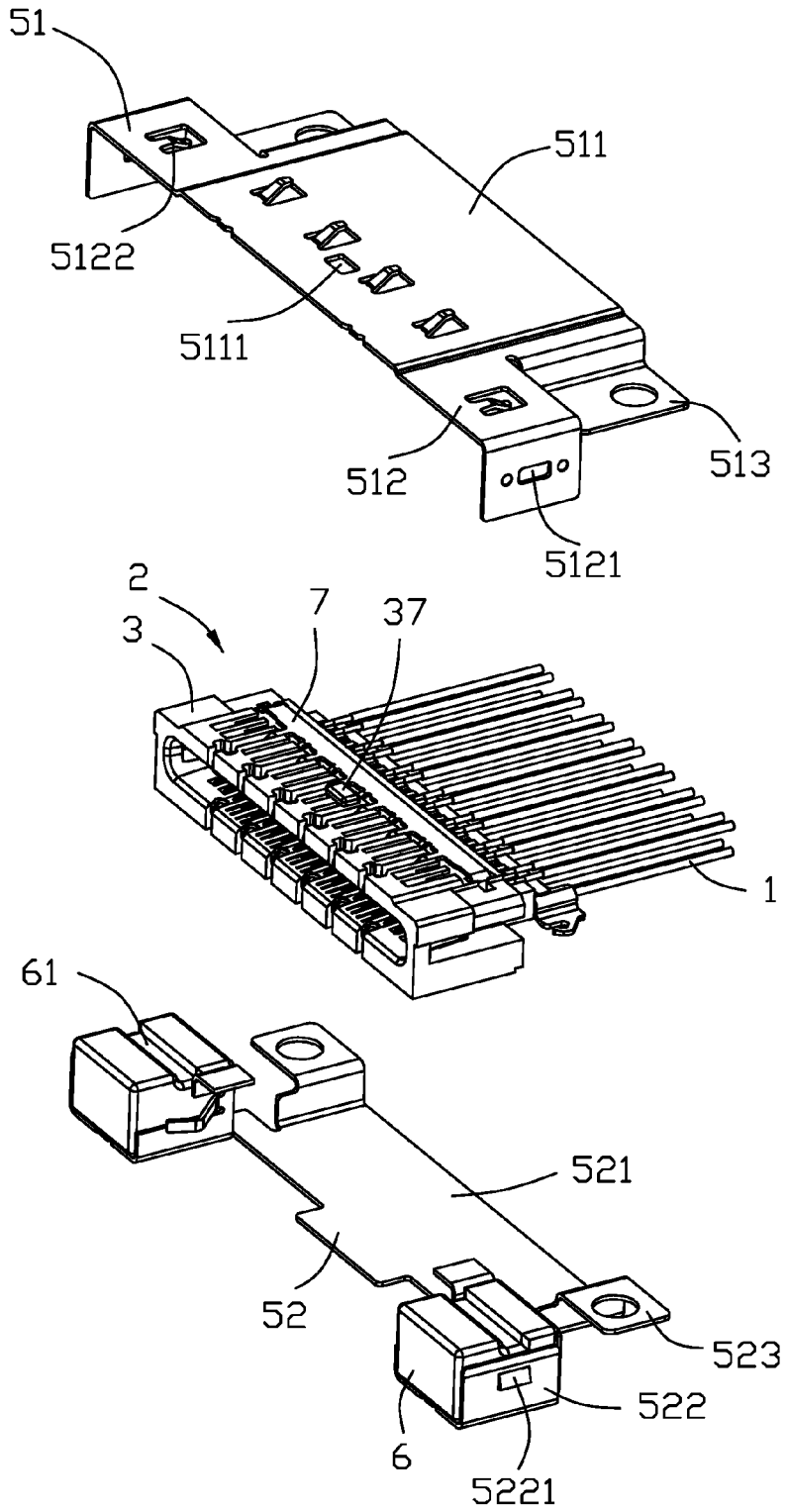
FIG. 3 is an exploded perspective view of the electrical cable connector of FIG. 1.
Figure 3A:
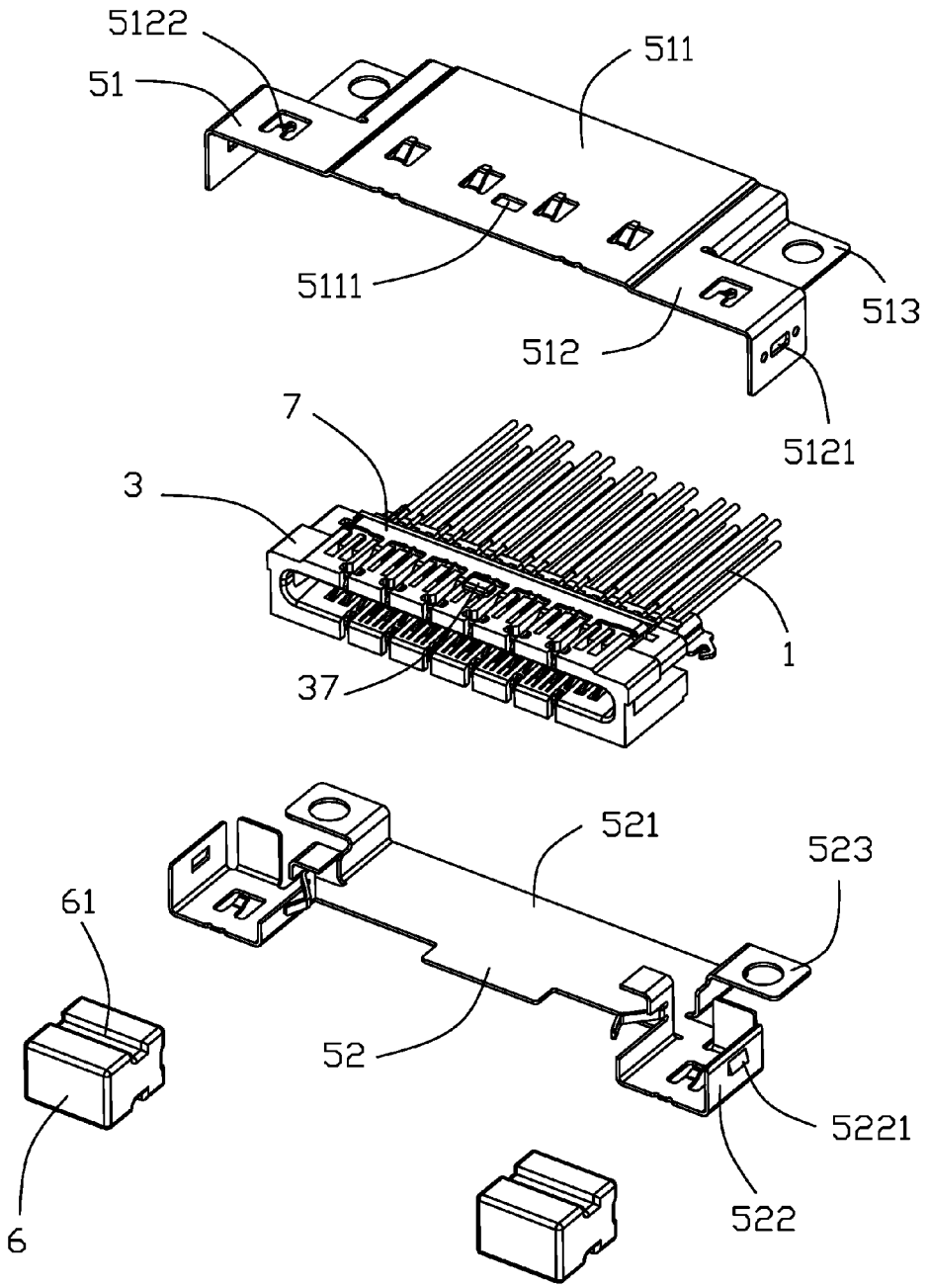
FIG. 3(A) is a further exploded perspective view of the electrical cable connector of FIG. 3.
Figure 4:
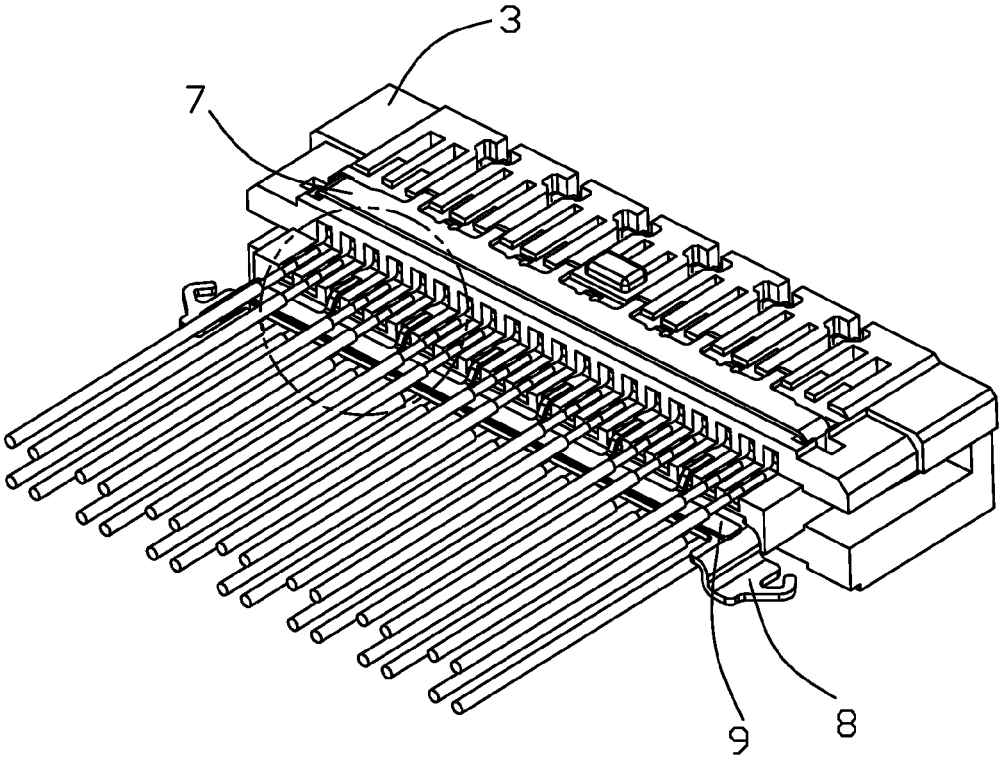
FIG. 4 is a perspective view of an internal subassembly of the electrical cable connector of FIG. 3.
Figure 5:
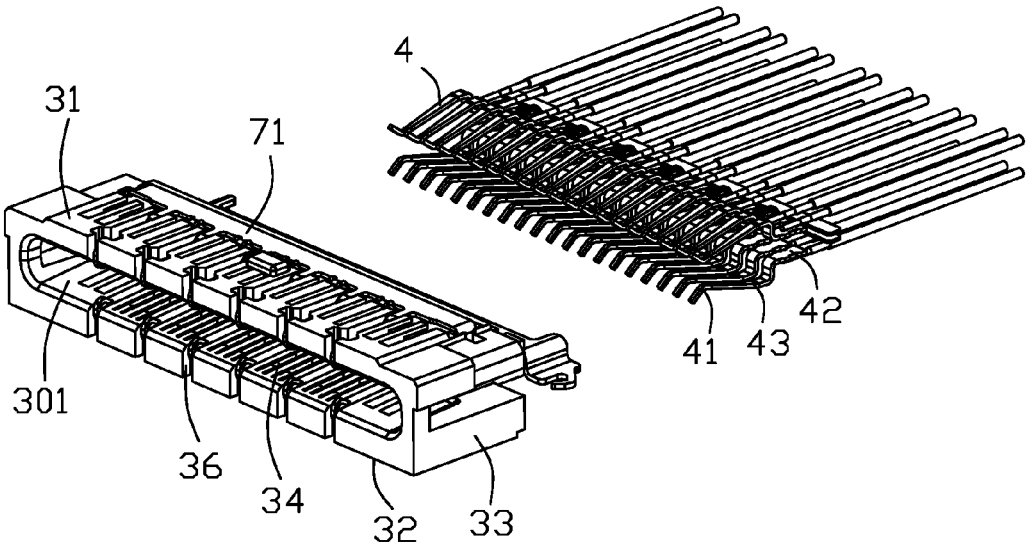
FIG. 5 is an exploded perspective view of the internal subassembly of the electrical cable connector of FIG. 4.
Figure 6:
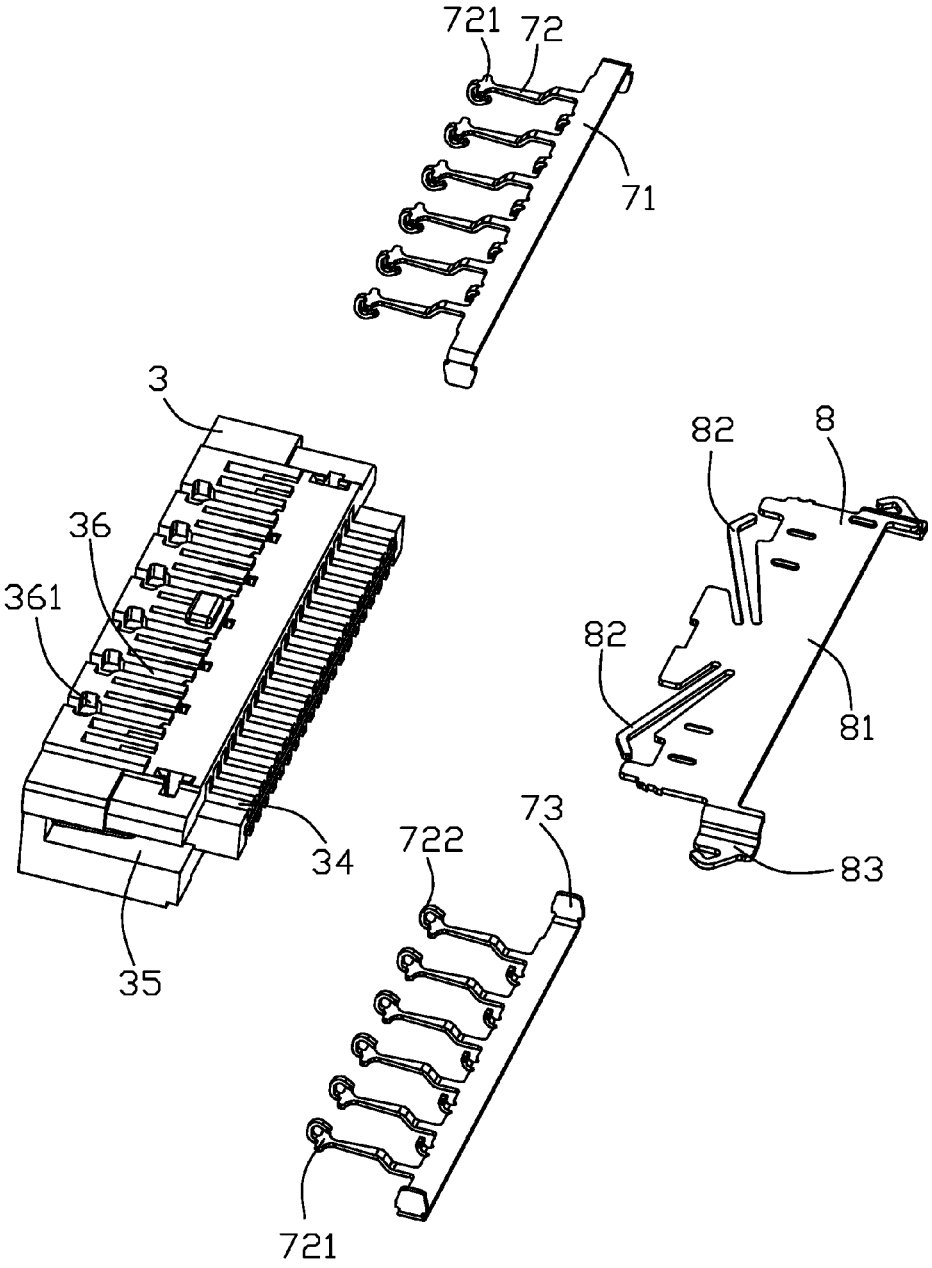
FIG. 6 is a further partial exploded perspective view of the internal subassembly of the electrical cable connector of FIG. 5.
Figure 7:
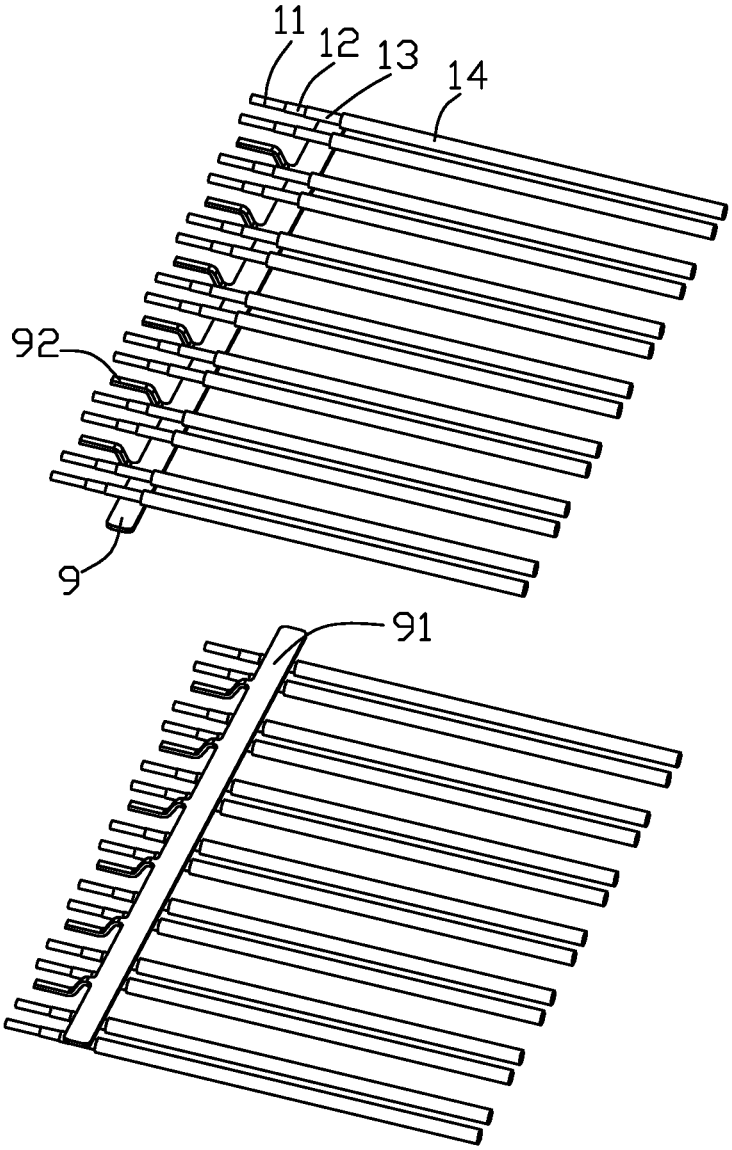
FIG. 7 is a further partial perspective view of the internal subassembly of the electrical cable connector of FIG. 5.
Figure 8:
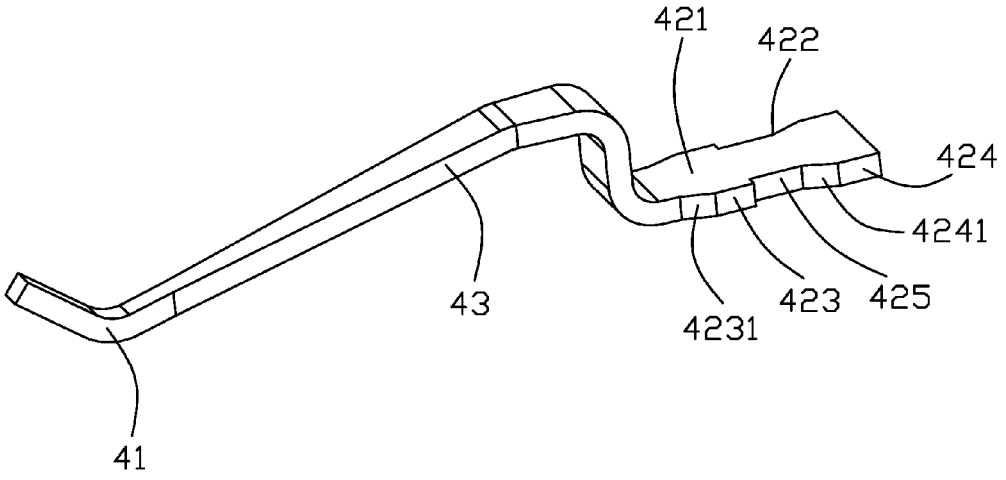
FIG. 8 is a perspective view of the contact of the electrical cable connector of FIG. 4.
Figure 9:
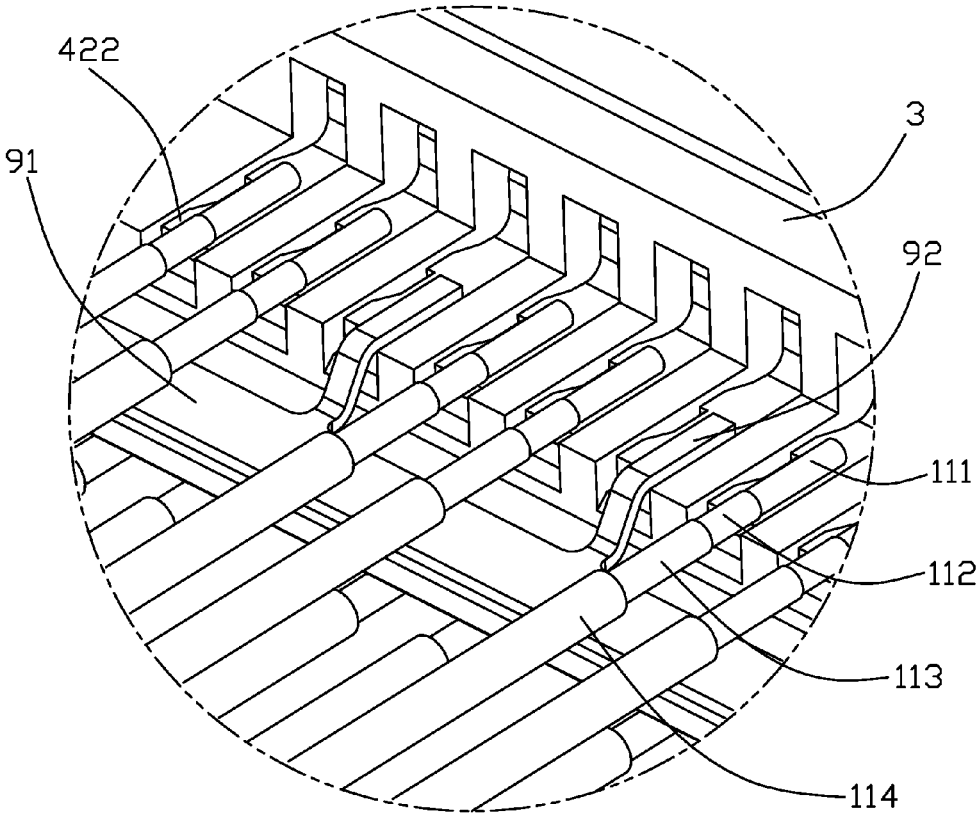
FIG. 9 is an enlarged partial perspective view of the internal subassembly of the electrical cable connector of FIG. 4 without the upper shell.
Figure 10:
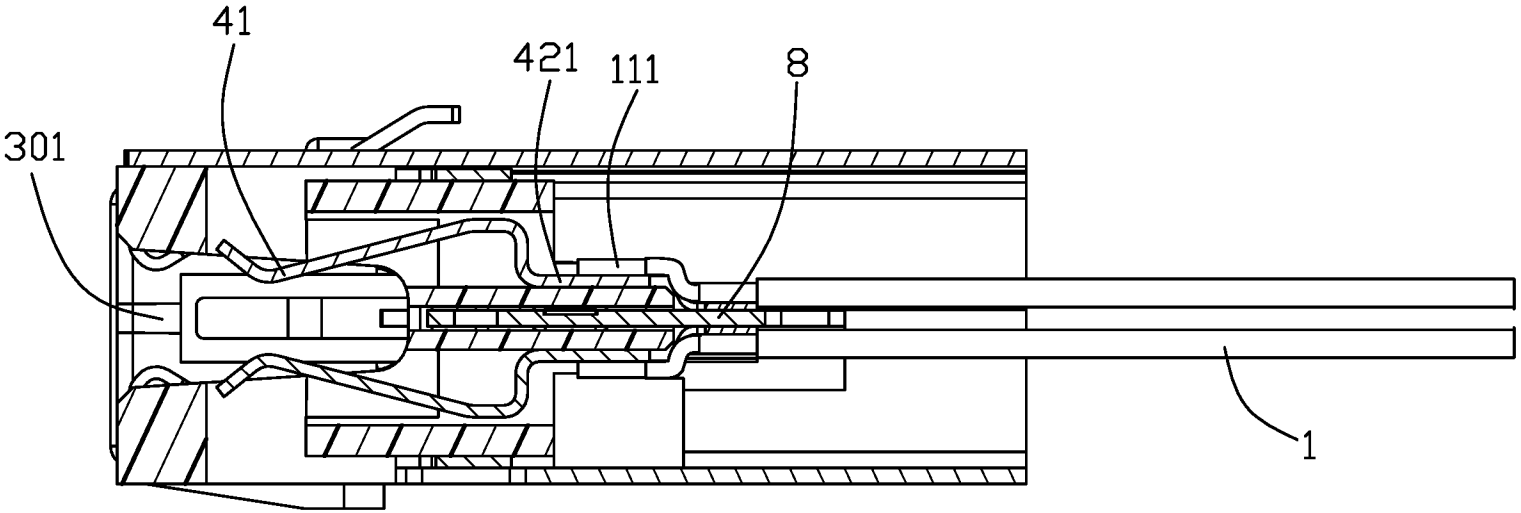
FIG. 10 is a cross-sectional view of the electrical cable connector of FIG. 1.
Figure 11:
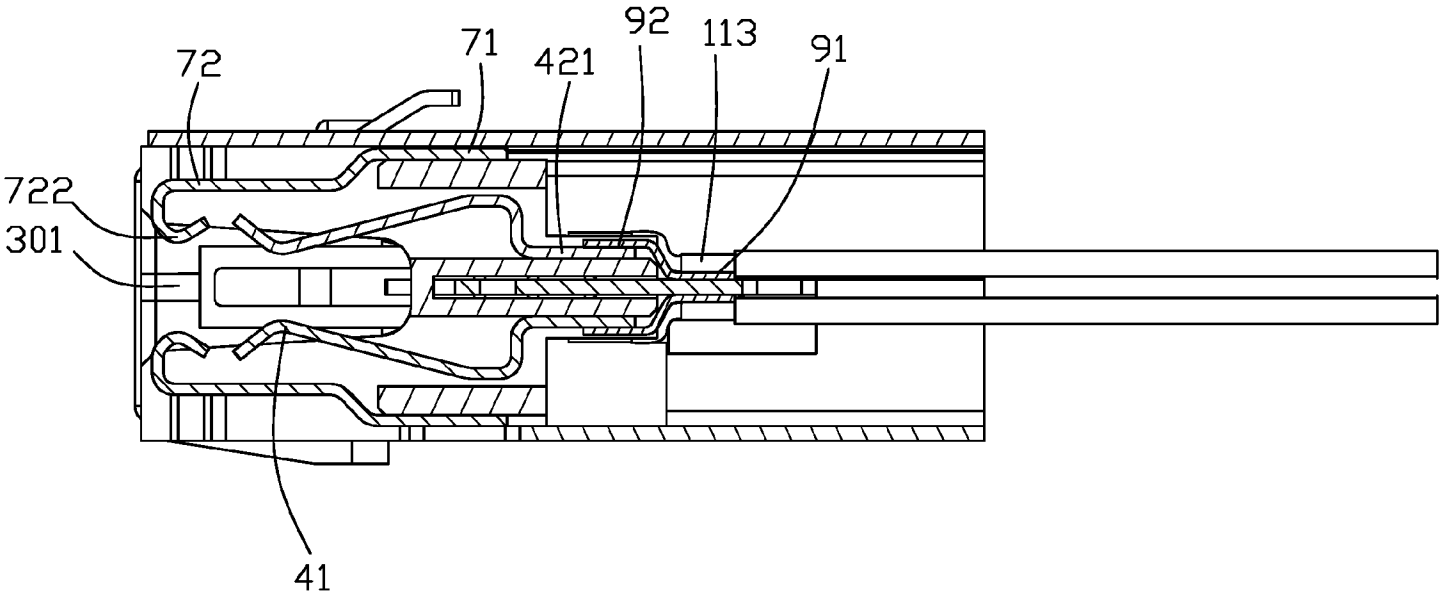
FIG. 11 is another cross-sectional view of the electrical cable connector of FIG. 1 without the upper shell.
Figure 12:
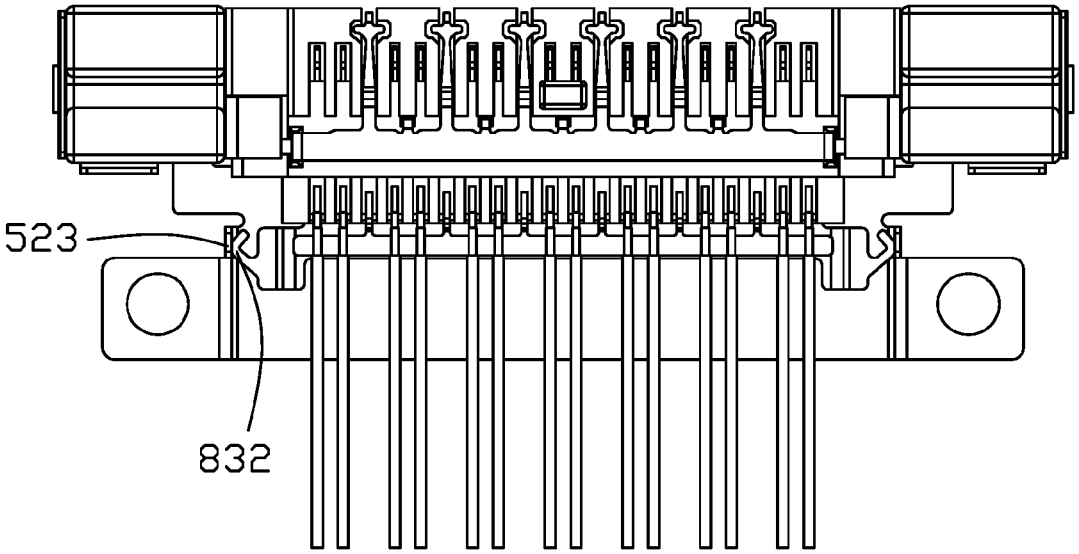
FIG. 12 is a top view of the electrical cable connector of FIG. 1 without the upper shell.

Referring to FIGS. 1-11, an electrical cable connector 100 includes a plurality of wires 1, an insulative housing 3, a plurality of terminals 4 disposed in the housing 3, and a metallic shell 5 enclosing the housing 3. The terminals 4 are assembled with the housing 3 and connected to the wires 1 to commonly form an internal subassembly 2. The shell 5 includes an upper shell 51 and a lower shell 52 assembled with each other in the vertical direction. A pair of magnetic elements 6 are sandwiched between the upper shell 51 and the lower shell 52.

Each wire 1 includes an inner conductor 11, an inner insulator 12 enclosing the inner conductor 11, a metal braiding 13 enclosing the inner insulator 12, and an outer insulator 14 enclosing the metal braiding 13. Front end regions of those inner conductor 11, inner insulator 12, the braiding 13 and the outer insulator 14 are sequentially exposed along an axial direction of the wire 1.

The housing 3 includes opposite upper wall 31, lower wall 32, and two side walls 33 connecting the upper wall 31 and the lower wall 32 to commonly form a mating cavity 301. The upper wall 31' and the lower wall 32 form the passageways 34 communicating with the mating cavity 301 and receiving the corresponding terminals 4. The side wall 33 forms a groove 35 to communicate with the mating cavity 301 in the transverse direction perpendicular to the vertical direction.

The terminals 4 are divided into upper and lower rows and forwardly assembled into the corresponding passageways 34 from a rear side of the housing 3. The terminal 4 includes a front contacting section 41, the rear connecting section 42 and a middle extension section therebetween in the front-to-back direction perpendicular to both the vertical direction and the transverse direction. The contacting section 41 extends toward and into the mating cavity 301. The connecting section 42 includes a soldering region 421 to be soldered to the inner conductor 11 of the corresponding wire 1, and a pair of retention regions/barbs 422 formed on two lateral sides of the soldering region 421 to be secured to the housing 3 in an interference fit. The retention barbs 422 on each lateral side includes a front barb 423 and a rear barb 424 with a space 425 therebetween, and each barb 423 and 424 includes a guiding face 4231, 4241. The transverse dimension of the connecting section 42 is larger than that of the extension section 43.

The internal subassembly 2 further includes a pair of (first) grounding bars 7 attached upon the upper wall 31 and the lower wall 32, respectively. The grounding bar 7 has a main body 71 attached upon the corresponding upper wall 31 or lower wall 32, a plurality of spring arms 72 extending forwardly from the main body 71, and a pair of fixing tabs 73 at two opposite ends in the transverse direction. The terminals 4 includes the differential pairs and grounding terminals alternately arranged with each other along the transverse direction. The spring arms 72 extend into the mating cavity 301 in front of the corresponding grounding terminals, respectively so as to contact the contacts of the complementary connector before the corresponding grounding terminals. The spring arm 72 is located in front of the corresponding grounding terminal and behind the front face of the housing 3. The spring arm 72 includes a pair of wings 721 and a contacting part 722 extending into the mating cavity 301. The upper wall 31 and the lower wall 32 forms the grooves 36 communicating with corresponding passageways 34 of the grounding terminals 4 for receiving the corresponding spring arms 72, and the receiving slots 361 for receiving the corresponding wings 721. The grooves 36 extend forwardly through the front face of the housing 3 and through the corresponding upper wall 31 and the lower wall 32 in the vertical direction to communicate with the mating cavity 301. The receiving slot 361 is wider than the groove 36 to support and the contacting part 722 extends into the mating cavity 301 in a preloaded manner accordingly.

The internal subassembly 2 further includes a metallic shielding plate 8 forwardly inserted into the housing 3 and between the upper row and the lower row of the terminals 4. The shielding plate 8 includes a main part 81, a pair of spring tangs 82 extending from the main part 81 into the mating cavity 301, and a pair of spring parts 83 at two opposite ends of the main part 81 in the transverse direction.

The internal subassembly 2 further includes a pair of (second) grounding bars 9. The grounding bar 9 includes an elongated base 91 and a plurality of extending arms 92 which are mechanically and electrically connected to the soldering regions 421 of the corresponding grounding terminal 4. The base 91 is seated upon the shielding plate 8 in the vertical direction.

The upper shell 51 covers the upper wall 31 and the lower shell 52 covers the lower wall 32. The upper shell 51 includes a main plate 511 with some spring fingers (not labeled) thereon for grounding with the system enclosure in which the electrical connector 100 is located, the pair of L-shaped front sides 512 and the pair of rear sides 513. The main plate 511 includes the fixing hole 5111 to receive the block 37 on the housing 3 for securing. The lower shell 52 includes a main plate 521, a pair of U-shaped front sides 522 and a pair of rear sides 523 where the spring parts 83 press so as to have the shielding plate 8 and the shell 5 are grounded together. The front sides 512 includes the fixing holes 5121 to receive the corresponding fixing tabs 5221 on the rear sides 522 so as to fix the upper shell 51 and the lower shell 52 together. The front sides 512 forms springs 5122 and the front sides 522 form springs 5222 to be engaged within the corresponding slits 61 of the magnetic elements 6, respectively. The front sides 522 forms the spring arms (not labeled) extending through the corresponding grooves 35 into the mating cavity 301.

The exposed inner conductor 111 is soldered upon the soldering region 421 of the differential pair, and the braiding 113 is soldered upon the base 91 while the extending arm 92 is soldered upon the soldering region 421 of the grounding terminal 4. On one hand, via cooperation of the metallic outer shell 5, the outer/contact/first grounding bars 7, the inner/wire/second bars 9 and the shielding plate 8 which electrically interconnect and interact with one another, the undesired signals may be removed; via the other hand, the length of the terminal 4 may be shortened by omitting the horizontally extending retention barbed section in the front-to-back direction, the dimension of the whole electrical cable connector can be minimized advantageously.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical cable connector comprising:

an insulative housing forming a mating cavity forwardly communicating with an exterior along a front-to-back direction;

a metallic shell enclosing the housing;

a plurality of passageways formed in the housing and extending along the front-to-back direction;

a plurality of terminals disposed in the corresponding passageways, respectively, each of said terminals including a front resilient contacting section extending into the mating cavity, a rear connecting section and an extension section therebetween in the front-to-back direction; and a plurality of wires located behind the housing, each of said wires including an inner conductor, an inner insulator, a braiding and an outer insulator concentrically arranged with one another in sequence; wherein the connecting section defines a soldering region with a pair of barbs at two lateral sides thereof, and the inner conductor is soldered upon the soldering region and the barbs retain the terminal in the corresponding passageway so as to omit barbs on the extension section and shorten a length of the terminal.

2. The electrical cable connector as claimed in claim 1, wherein the terminals are categorized with differential pairs and grounding terminals alternately arranged with each other along a transverse direction perpendicular to the front-to-back direction.

3. The electrical cable connector as claimed in claim 2, wherein an outer grounding bar is attached upon an exterior surface of the housing and intimately enclosed in the metallic shell, and said outer grounding bar includes a plurality of contacting parts extending into the mating cavity and located in front of the corresponding grounding terminals, respectively.

4. The electrical cable connector as claimed in claim 2, wherein an inner grounding bar is associated with the wires, and said inner grounding bar includes an elongated base with a plurality of spring arms mechanically and electrically connected to the soldering regions of the grounding terminals, respectively.

5. The electrical cable connector as claimed in claim 4, wherein the braiding is soldered upon the base.

6. The electrical cable connector as claimed in claim 5, further including a metallic shielding plate is inserted into the housing and separating said terminals in two groups, wherein said shielding plate respectively mechanically and electrically connect to the metallic shell and the inner grounding bar.

7. The electrical cable connector as claimed in claim 6, wherein said shielding plate includes a spring tang forwardly extending into the mating cavity.

8. The electrical cable connector as claimed in claim 1, wherein said metallic shell has front sides enclosing a pair of magnetic elements by two lateral sides of the mating cavity, and further including a pair of spring fingers extending around the corresponding magnetic elements through corresponding grooves of the housing into the mating cavity in a transverse direction perpendicular to said front-to-back direction.

9. An electrical cable connector comprising:

an insulative housing forming a mating cavity forwardly communicating with an exterior along a front-to-back direction;

a metallic shell enclosing the housing;

a plurality of passageways formed in the housing and extending along the front-to-back direction;

a plurality of terminals disposed in the corresponding passageways, respectively, each of said terminals including a front resilient contacting section extending into the mating cavity, a rear connecting section with a soldering region thereon and an extension section therebetween in the front-to-back direction; and a plurality of wires located behind the housing, each of said wires including an inner conductor, an inner insulator, a braiding and an outer insulator concentrically arranged with one another in sequence; wherein the terminals are categorized with differential pairs and grounding terminals alternately arranged with each other along a transverse direction perpendicular to the front-to-back direction; wherein an inner grounding bar is associated with the wires, and said inner grounding bar includes an elongated base with a plurality of spring arms mechanically and electrically connected to the soldering regions of the grounding terminals, respectively wherein the braiding is soldered upon the base.

10. The electrical cable connector as claimed in claim 9, further including a metallic shielding plate forwardly inserted into the housing from a rear side of the housing and dividing said terminals in two groups, wherein said inner grounding bar is seated upon the shielding plate and the shielding plate is mechanically and electrically connected to the metallic shell.

11. The electrical cable connector as claimed in claim 10, wherein said shielding plate includes a spring tang forwardly extending into the mating cavity.

12. The electrical cable connector as claimed in claim 10, wherein an outer grounding bar is attached upon an exterior surface of the housing and intimately enclosed in the metallic shell, and said outer grounding bar includes a plurality of contacting parts extending into the mating cavity and located in front of the corresponding grounding terminals, respectively.

13. The electrical cable connector as claimed in claim 12, wherein each contacting part is equipped with a pair of wings to have the corresponding contacting part deflected in a preloaded manner.

14. The electrical cable connector as claimed in claim 10, wherein said shell has front sides enclosing a pair of magnetic elements by two lateral sides of the mating cavity, and further including a pair of spring fingers extending around the corresponding magnetic elements through corresponding grooves of the housing into the mating cavity in a transverse direction perpendicular to said front-to-back direction.

15. The electrical cable connector as claimed in claim 9, wherein the connecting section is equipped with barbs while the extension section is free from barbs.

16. An electrical cable connector comprising:

an insulative housing forming a mating cavity forwardly communicating with an exterior along a front-to-back direction;

a metallic shell enclosing the housing;

a plurality of passageways formed in the housing and extending along the front-to-back direction;

a plurality of terminals disposed in the corresponding passageways, respectively, each of said terminals including a front resilient contacting section extending into the mating cavity, a rear connecting section with a soldering region thereon and an extension section therebetween in the front-to-back direction; and a plurality of wires located behind the housing, each of said wires including an inner conductor, an inner insulator, a braiding and an outer insulator concentrically arranged with one another in sequence; wherein the terminals are categorized with differential pairs and grounding terminals alternately arranged with each other along a transverse direction perpendicular to the front-to-back direction; wherein an outer grounding bar is attached upon an exterior surface of the housing and intimately enclosed in the metallic shell, and said outer grounding bar includes a plurality of contacting arms extending into the mating cavity and located in front of the corresponding grounding terminals, respectively; wherein a metallic shielding plate is forwardly inserted into the housing from a rear side of the housing and separating said terminals into two groups, and mechanically and electrically connected to the metallic shell.

17. The electrical cable connector as claimed in claim 16, wherein said shielding plate includes a spring tang forwardly extending into the mating cavity.

18. The electrical cable connector as claimed in claim 16, wherein each contacting arm is equipped with a pair of wings to have the corresponding contacting arm deflected in a preloaded manner.

19. The electrical cable connector as claimed in claim 16, wherein said shell has front sides enclosing a pair of magnetic elements by two lateral sides of the mating cavity, and further including a pair of spring fingers extending around the corresponding magnetic elements through corresponding grooves of the housing into the mating cavity in a transverse direction perpendicular to said front-to-back direction.

20. The electrical cable connector as claimed in claim 16, wherein the connecting section is equipped with barbs while the extension is free from barbs.

* * * * *